US005301866A

United States Patent [19]

Veh et al.

[11] Patent Number: 5,301,866

[45] Date of Patent: Apr. 12, 1994

[54] WEB BREAKAGE DETECTOR

[75] Inventors: Karl Veh, Diedorf; Andreas Birkenfeld, Neusäss, both of Fed. Rep. of Germany

[73] Assignee: Grafotec Kotterer GmbH, Diedorf, Fed. Rep. of Germany

[21] Appl. No.: 950,483

[22] Filed: Sep. 24, 1992

[30] Foreign Application Priority Data

Oct. 19, 1991 [DE] Fed. Rep. of Germany ..... 4134590

[51] Int. Cl.[5] ..... B65H 26/04

[52] U.S. Cl. ..... 226/11; 400/708; 101/424.1; 101/484; 226/45; 226/196

[58] Field of Search ..... 101/424.1, 484; 400/708; 226/11, 45, 196; 34/49

[56] References Cited

U.S. PATENT DOCUMENTS

| | | | |
|---|---|---|---|
| 4,667,946 | 5/1987 | Taguchi et al. | 270/52.5 |
| 4,838,498 | 6/1989 | Huth | 242/75.51 |
| 4,968,386 | 11/1990 | Nguyen | 162/262 |
| 5,052,233 | 10/1991 | Rantala | 73/862.45 |
| 5,190,201 | 3/1993 | Briggs | 26/1 |

FOREIGN PATENT DOCUMENTS 3939226 5/1991 Fed. Rep. of Germany .

*Primary Examiner*—Edgar S. Burr
*Assistant Examiner*—Lynn D. Hendrickson
*Attorney, Agent, or Firm*—Edwin D. Schindler

[57] ABSTRACT

In the case of a web breakage detector for web processing machines and more particularly for web feed printing machines, comprising a device for monitoring the web tension and adapted to produce a signal in the event of the web tension decreasing, a high degree of reliability and ease of operation are possible if said monitoring device is designed in the form of a pressure measuring device, which comprises a web pressure sensor for detecting the pressure in a gap delimited during normal operation on the one hand by the web and on the other hand by a stationary cover passed by the web, such sensor being adapted to produce a signal in the event of a pressure drop occurring in the gap.

9 Claims, 1 Drawing Sheet

WEB BREAKAGE DETECTOR

BACKGROUND OF THE INVENTION

The present invention relates to a web breakage detector for web processing machines and more particularly for web feed printing machines, comprising a device for monitoring the web tension and adapted to produce a signal in the event of the web tension decreasing.

A device of this type is described in German patent publication 3,939,226 A1. In the case of this known arrangement the monitoring device consists of a photoelectric detector whose optical path is intercepted by one longitudinal edge of the web and a blowing nozzle acting on the web with a force exceeded by the normal web tension. In this case it is necessary to set the photoelectric detector and the nozzle associated with it exactly at the edge of the web. A further point to be considered is that the force of the blown air from the nozzle has to be set in accordance with the quality of the paper. Accordingly there is a generally elaborate adjustment routine; and furthermore there is the danger of failure to perform the correct adjustments. The known arrangement is consequently not sufficiently easy to operate and not sufficiently reliable.

SHORT SUMMARY OF THE INVENTION

Taking this prior art as a starting point on object of the present invention is to improve upon a web breakage detector of the type initially mentioned, using simple and favorably priced means, that the system is easy to operate and reliable in its functions.

In order to achieve these and/or other objects appearing from the present specification, claims and drawings, in the present invention the monitoring device is designed in the form of a pressure measuring device, which comprises a pressure sensor for detecting the pressure in a gap delimited during normal operation on the one hand by the web and on the other hand by a stationary cover passed by the web, such sensor being adapted to produce a signal in the event of a pressure drop occurring in the gap.

The arrangement in accordance with the invention offers the advantage of not needing any individual adjustment in accordance with the breadth of the web and the quality of the paper, and in fact may be so simply adjusted when put into operation that all webs which are likely to be processed may be reliably monitored. Nevertheless the arrangement in accordance with the invention possesses a high response speed, since the gap between the web and the cover suddenly increases in the event of there being a web breakage accompanied by a collapse of the gage pressure obtaining during normal operation. A still further advantage of the measures in accordance with the invention is to be seen in the fact that there is no web contact with the stationary cover so that despite the use of a stationary member there is no likelihood of affecting the web surface which generally bears a layer of wet ink.

In accordance with a further possible advantageous development of the invention it is possible for the monitoring device to be designed in the form of a differential pressure measuring device, which possesses a pressure sensor responsive to the pressure in the gap and a pressure sensor responsive to the pressure of the surroundings and in the case of the gap pressure approaching the pressure of the surroundings, and more particularly if the pressure difference goes down to zero, produces a signal. These measures render possible an extremely simple but nevertheless reliable processing of the data or signals and thus despite a simple and sturdy design lead to a high degree of safety.

It is an advantage for the cover to be designed in the form of a stationary plate which is parallel to the web. This feature is responsible for a gap extending over a large area, in which the pressure may be built up reliably.

As another advantageous feature of the invention it is possible for the plate constituting the cover to have at least one chamber which is delimited by a surrounding rim and is open towards the web, the pressure therein being able to be sensed by the associated pressure sensor. The said chamber is responsible for the advantage of ease in sensing the pressure in the gap and leads to a satisfactory evening out of the gap pressure.

It is convenient for the plate to have a plurality of chambers with the centrally arranged chamber being able to be scanned or sensed by means of the associated pressure sensor. This measure facilitates the production of a particularly high pressure.

A further advantageous feature of the invention is such that at least adjacent to the limit of the gap which is trailing in terms of the direction of movement of the web it is possible to provide a blowing means supplied with air and having at least one nozzle opening into the gap. Such a blowing device aids and improves the supply of air, caused by the moving web, into the gap. In order to hinder rapid venting of the gap it is possible, in accordance with a further feature of the invention, to have a blowing means which is supplied with air and is arranged at the limit of the gap which is leading in terms of the direction of movement of the web, having at least on nozzle opening into the gap.

It is furthermore expedient for the plate constituting the cover to be arranged over the web so that in the case of the web breaking the web will be automatically moved clear of the plate by its own weight.

Further advantageous developments and features of the invention will be gathered from the following description of one working embodiment with reference to the drawing and in conjunction with the claims.

LIST OF THE SEVERAL VIEWS OF THE FIGURES

DETAILED ACCOUNT OF WORKING EMBODIMENT OF THE INVENTION

Figure 1:
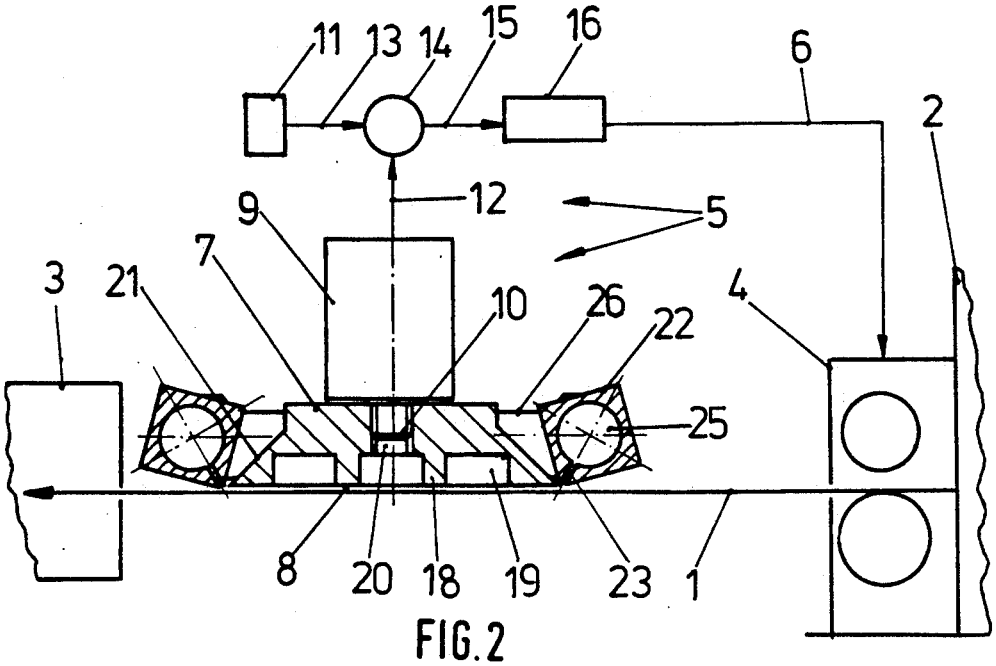
FIG. 1 is a longitudinal section taken through a web breakage switch or detector in accordance with the invention with an associated with web catching device.

FIG. 1 shows a web 1 of paper which is printed in a printing press 2 and is then dried in a dryer 3. In the dryer 3 the paper web 1 is particularly likely to be broken. In order to prevent damage to the printing press being caused by the web, for instance by its being wound up onto one of the rolls of the press, there is a catching device 4 arranged upstream from the danger zone, in the present case the dryer 3 and downstream from the press 2. The design and the workings of such catch device are inherently known so that a detailed account thereof is not called for in the present connection. The catch device 4 is tripped by a signal from a web break detector generally referenced 5, as is indicated by the signal direction arrow 6.

The web break detector 5 comprises a stationary plate 7 fitting over the paper web 1 in an edge part and which together with the paper web 1 moving past without making contact with the lower surface of the plate delimits a gap 8. During normal operation a gage pressure is established in the gap 8. In the event of a web break occurring the paper web 1 will become slack and sag so that the gap 8 will be automatically increased in size and the gage pressure present will disappear. This change in pressure is utilized for tripping or activating the catch device 4.

For this purpose a pressure sensor 9 is secured to the plate 7, its responsive port 10 being accessible from the gap 8. With the aid of the pressure sensor 9 the pressure present in the gap 8 may accordingly be detected. Furthermore the web break detector 5 comprises a further pressure sensor 11 responsive to the pressure of the surroundings. The output ports of the pressure sensors 9 and 11 are connected, as is indicated by the signal direction arrows 12 and 13, with the input connections of a subtracting device 14, which subtracts the value of the pressure of the surroundings as detected by the pressure sensor 11 from the value of the pressure in the gap as detected by the pressure sensor 9. During normal operation the gap pressure will be larger than the pressure of the surroundings so that the subtracting device 14 will detect a pressure difference. In the event of there being a web break, the paper web will move clear of the plate 7, as explained above, so that the gage pressure established between the plate 7 and the paper web 1 will collapse and will drop to the pressure of the surroundings. As soon as this happens the subtraction device 14 will no longer detect any pressure differential.

The output port of the subtraction device 14 is connected, as indicated by the signal arrow 15, with the input port of an operating member 16, which is adapted to be operated by the actuating device of the catch device 4. The circuit of the operating member 16 is such that a trip signal is produced as soon as the difference as detected by the subtraction device 14 approaches zero. The trip signal produced by the operating member 16 is transmitted via the signal connection 6 to the actuating device of the catch device 4. The pressure sensor 11 and/or the subtracting device 14 and/or the operating member 16 may in practice be combined with the pressure sensor 9 as a single unit or assembly.

Figure 2:
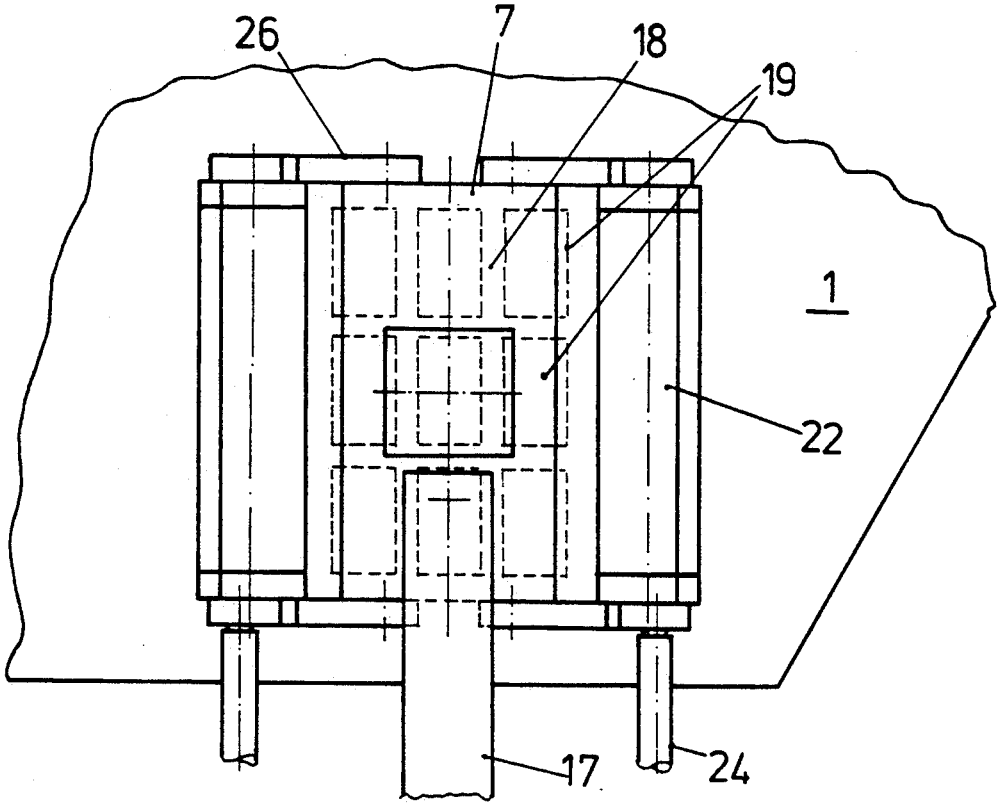
FIG. 2 is a plan view of the web breakage detector in accordance with the invention.

The stationary plate 7 is, as shown in FIG. 2, mounted on a supporting holder 17 mounted on a side frame of the printing press and designed in the form of a cantilever arm. The plate 7 is in this respect so arranged that it is completely within the paper web 1, that is to say it is overlapped by the same laterally. The arrangement may be such that this is the case when processing all web widths coming into question. The distance between the lower surface, parallel to the conveying plane of the paper web 1, of the plate 7 and the regular conveying plane of the paper web 1 is small. It is convenient if this distance is less than one millimeter.

The plate 7 is provided with a plurality of chambers 19 which in the present case are distributed in three rows, are open towards the paper web and are delimited by surrounding ribs 18. The central chamber 19 has a drilled hole extending into it from the top side of the plate. The drilled hole 20 has the pressure sensor 9 mounted on it. In the illustrated working embodiment of the invention the hole 20 is screw threaded in order to receive the screw threaded spigot of the input connection of the pressure sensor 9. With the aid of the pressure sensor 9 the pressure in the central chamber 19 is accordingly measured.

The gap 8 and the chambers 19 in communication with it are so supplied with air entrained by the paper web 1 moving at a high speed that a gage pressure is built up in the gap 8 and accordingly furthermore in the chambers 19 connected with the same. In order to reduce eddy formation adjacent to the flanks running transversely in relation to the direction of the web, of the plate 7 it is possible for the flanks, as best shown in FIG. 1, to be in the form of chamfered, tapered portions 21. In the illustrated working embodiment of the invention in order to stabilize the pressure in the gap the plate 7 is preceded and followed by blowing devices. The latter are in the form of jet banks 22 extending along the edges, which are trailing and leading in terms of the direction of movement of the web, of the plate 7 and running along the full width of the plate 7, such jet banks 22 being having equally spaced out blowing nozzles 23. The banks 22 have such an alignment that the direction of blowing has a component pointing into the gap 8. For this purpose the axis of the blowing nozzles 22 of the trailing blowing device is inclined to the rear in relation to a vertical drawn on to conveying plane 1 of the paper and the axis of the blowing nozzles 23 of the leading blowing device is inclined forwards in relation to a vertical drawn on to conveying plane 1 of the paper. In the illustrated working embodiment of the invention such inclination is equal to respectively 45°.

The nozzle banks 22 are, as shown in FIG. 2 as well, supplied by laterally connected compressed air ducts 24 with air to be blown. The rate and the pressure are in this case so selected that during normal operation the back pressure acting on the paper web 1 is readily overcome by the tension of the web so that no deflection of the paper web 1 is occasioned thereby. The nozzle banks or bars 22 are in the illustrated working embodiment in the form of drilled rails having a square cross section. The axial hole 25 connected with a compressed air line 24 constitutes in this respect a distributor or manifold chamber feeding the blowing nozzle 23. The nozzle may simply be in the form of diagonal drilled holes so that nozzles are long and thus positively guide the air. The nozzle banks 22 are secured to the plate 7 by means of end lugs 26 which respectively shut off their terminal holes 25.

We claim:

1. A web breakage detector for a web processing machine, particularly for a web feed printing machine, said web breakage detector comprising:

means for monitoring a level of tension of a web in a web processing machine, said means for monitoring including a pressure measuring device having a pressure sensor for detecting a level of pressure in a gap of higher pressure delimited during normal operation by said web on a first side and, on a second side, by a stationary cover of said means for monitoring, said stationary cover being a stationary plate disposed parallel with said web, said web passing along said stationary plate with a gap spacing leading to development of high pressure in said gap, said pressure sensor producing a signal a decrease in pressure in said gap, said stationary plate having a plurality of chambers open on said first side delimited by said web said plurality of chambers including a centrally arranged chamber, the pressure of said centrally arranged chamber being detected by said pressure sensor.

2. The web break detector as claimed in claim 1, wherein the monitoring device is in the form of a pressure differential measuring device which comprises a pressure sensor for the pressure in the said gap and a pressure sensor for the pressure of the surroundings and adapted to produce a signal in the event of the pressure in said gap approaching the pressure of the surroundings and more particularly if the pressure differential ceases to be present.

3. The web break detector as claimed in claim 1, wherein said pressure sensor is attached to said stationary plate.

4. The web break detector as claimed in claim 1, comprising a blowing device adjacent to the edge, which is trailing in terms of the direction of the web, of the gap, said blowing device being adapted to blow air towards the gap through a nozzle directed towards such gap.

5. The web break detector as claimed in claim 1, comprising a blowing device adjacent to the edge, which is leading in terms of the direction of the web, of the gap, said blowing device being adapted to blow air towards the gap through a nozzle directed towards such gap.

6. The web break detector as claimed in claim 4, wherein such blowing device adjacent to the edge, which is trailing in terms of the direction of the web, is constituted by a nozzle bank extending across the full width of the plate.

7. The web break detector as claimed in claim 5, wherein such blowing device adjacent to the edge, which is leading in terms of the direction of the web, is constituted by a nozzle bank extending across the full width of the plate.

8. The web break detector as claimed in claim 1, wherein such plate is tapered adjacent to leading and trailing edges thereof.

9. The web break detector as claimed in claim 1, wherein such plate is arranged over said web.

* * * * *